US006067360A

United States Patent [19]

Kasai et al.

[11] Patent Number: 6,067,360

[45] Date of Patent: May 23, 2000

[54] APPARATUS FOR LOCALIZING A SOUND IMAGE AND A METHOD FOR LOCALIZING THE SAME

[75] Inventors: Joji Kasai; Kazumasa Takemura; Tetsuro Nakatake; Koichi Sadaie; Kenichiro Toyofuku, all of Neyagawa, Japan

[73] Assignee: Onkyo Corporation, Osaka, Japan

[21] Appl. No.: 09/192,507

[22] Filed: Nov. 17, 1998

[30] Foreign Application Priority Data

Nov. 18, 1997 [JP] Japan ..... 9-335026

[51] Int. Cl.[7] ..... H04R 5/00

[52] U.S. Cl. ..... 381/1; 381/17; 381/18

[58] Field of Search ..... 381/1, 17, 18, 381/19, 20, 21, 22, 23, 63

[56] References Cited

U.S. PATENT DOCUMENTS

| | | | |
|---|---|---|---|
| 4,349,698 | 9/1982 | Iwahara | 381/1 |
| 5,325,435 | 6/1994 | Date et al. | 381/1 |
| 5,440,638 | 8/1995 | Lowe et al. | 381/17 |
| 5,524,053 | 6/1996 | Iwamatsu | 381/18 |
| 5,546,465 | 8/1996 | Kim | 381/18 |
| 5,579,396 | 11/1996 | Iida et al. | 381/18 |
| 5,680,464 | 10/1997 | Iwamatsu | 381/18 |
| 5,761,315 | 6/1998 | Iida et al. | 381/1 |
| 5,799,094 | 8/1998 | Mouri | 381/18 |
| 5,822,438 | 10/1998 | Sekine et al. | 381/1 |
| 5,844,993 | 12/1998 | Iida et al. | 381/18 |
| 5,870,480 | 2/1999 | Griesinger | 381/18 |
| 5,974,153 | 10/1999 | Cashion et al. | 381/1 |

OTHER PUBLICATIONS

English Abstract of Japanese Laid–open publication HEI 7–212898.

English Abstract of Japanese Laid–open publication HEI 7–95697.

*Primary Examiner*—Forester W. Isen
*Assistant Examiner*—Xu Mei
*Attorney, Agent, or Firm*—Michael D. Bednarek; Crowell & Moring LLP

[57] ABSTRACT

It is an object of the present invention to provide an apparatus for localizing a sound image capable of achieving so called "surround-effect" sufficiently with a simple structure while maintaining a sufficient width of a frontal sound field. Both surround left and surround right signals SL, SR are supplied to a sideward localizer 12 for localizing the sound image reproduced by the signals to positions of sideward of a listener. Also, front left and front right signals FL, FR are supplied to the sideward localizer 12. In this way, the sound image reproduced by the signals is localized at positions between speakers arranged in front side and sidewards of the listener, so that a sufficient width of frontal sound field can be maintained eventually.

14 Claims, 10 Drawing Sheets

APPARATUS FOR LOCALIZING A SOUND IMAGE AND A METHOD FOR LOCALIZING THE SAME

CROSS-REFERENCE TO RELATED APPLICATION

The entire disclosure of Japanese Patent application No. Hei 9-335026 filed on Nov. 18, 1997 including specification, claims, drawings, and summary is incorporated herein by reference in its entirety.

BACKGROUND OF INVENTION

1. Field of the Invention

This invention relates an apparatus and a method for localizing a sound image, more specifically the simplification of its structure and the processes.

2. Description of the Prior Art

An apparatus for localizing a sound image disclosed in Japanese Laid-open publication No. Hei 8-265899 (265899/1996) is shown in FIG. 9. The apparatus is used to make a listener 2 to feel that sound image reproduced by speakers XL and XR (hereinafter referred to as virtual speakers) is virtually localized at rear sides to the listener 2. By utilizing the apparatus, the listener 2 is able to feel like that he/she is surrounded by the sound reproduced with the speakers 4L and 4R as well as surrounded by the sound reproduced with the virtual speakers XL and XR even when only the speakers 4L and 4R are actually arranged.

In the apparatus shown in FIG. 9, a total of four filters 6*a*, 6*b*, 6*c* and 6*d* are used to realize the sound image localization. Transfer functions H11, H12, H13 and H14 of respective filters are shown as following equations:

$$H11=(h_{RR}h_{L'L}-h_{RL}h_{L'R})/(h_{LL}h_{RR}-h_{LR}h_{RL})$$

$$H12=(h_{LL}h_{L'R}-h_{LR}h_{L'L})/(h_{LL}h_{RR}-h_{LR}h_{RL})$$

$$H21=(h_{RR}h_{R'L}-h_{RL}h_{R'R})/(h_{LL}h_{RR}-h_{LR}h_{RL})$$

$$H22=(h_{LL}h_{R'R}-h_{LR}h_{R'L})/(h_{LL}h_{RR}-h_{LR}h_{RL})$$

Wherein $h_{RR}$ is a transfer function from the speaker 4R to the right ear 2R of the listener 2, $h_{RL}$ is a transfer function from the speaker 4R to the left ear 2L of the listener 2, $h_{LL}$ is a transfer function from the speaker 4L to the left ear 2L of the listener 2, and $h_{LR}$ is a transfer function from the speaker 4L to the right ear 2R of the listener 2.

Incidentally, equations $h_{LL}=h_{RR}$, $h_{LR}=h_{RL}$, $h_{L'L}=h_{R'R}$, $h_{L'R}=h_{R'L}$ are satisfied in the equations stated above when the speakers 4R, 4L and the speakers XR, XL are arranged symmetric with respect to a central axis 8 through the listener 2. As a result, equations H11=H22, and H12=H21 can be derived, so that the apparatus can be realized by utilizing a total of two filers as shown in FIG. 10. Here, transfer functions $H_{SUM}$, $H_{DIF}$ can be defined by the following equations:

$$H_{SUM}=(h_{a'}+h_{b'})/(h_a+h_b)$$

$$H_{DIF}=(h_{a'}-h_{b'})/(h_a-h_b)$$

wherein equations $h_a=h_{LL}=h_{RR}$, $h_b=h_{LR}=h_{RL}$, $h_a'=h_{L'L}=h_{R'R}$ and $h_b'=h_{L'R}=h_{R'L}$ are satisfied.

Thus, the sound images can be localized at positions of the speakers arranged virtually with a simple structure when the actual speakers are symmetrically arranged.

Although, a sound effect so called "surround-effect" can be achieved by using a total of two speakers in the conventional technology, not much attention is paid to widen a width of frontal sound field (hereinafter referred to as frontal width) defined between the speakers arranged in a front side. Therefore, it is not possible to enjoy the "surround-effect" at sufficient level because of insufficient frontal width in an electric appliance such as a television set having a limited width for installing speakers therein.

Further, a technology to localize virtual speakers to outward of the front speakers is disclosed in Japanese Laid-open publication No. SHO 52-116202 (116202/1977). Although, the frontal width can be widen by applying the technology to both signals for left and right channels, additional circuits respectively carrying out localization of both the channels are required for widening the frontal width in addition to a circuit to perform processings of surround channel signals.

Still further, a technology achieving the "surround-effect" by using processings for localizing a sound image with respect to a surround channel signal is also disclosed in both Japanese Laid-open publications No. Hei 7-95697 (95697/1995) and No. Hei 7-212898 (212898/1995). However, the technologies disclosed therein do not allow to widen the frontal width.

SUMMARY OF THE INVENTION

It is an object of the present invention to overcome the above mentioned drawbacks associated with prior arts, and to provide an apparatus for localizing a sound image capable of achieving sufficient "surround-effect" with a simple structure while maintaining a sufficient frontal width.

In accordance with characteristics of the present invention, there is provided an apparatus and a method for localizing a sound image, in which localization processings for localizing the sound image at sideward of a listener is further carried out to both a left and a right front signal so as to localize the sound image at positions between each of a left and a right speakers actually arranged and the sound image virtually localized at sideward of the listener. In this way, the sound image reproduced by the left front and the right front signal can be shifted at positions sideward of the speakers actually arranged in front. Thereby, the frontal width can be widen even when the width defined between the speakers is narrow. Moreover, localization of the sound image reproduced by the left and right front signal is carried out by the side localization processing for the surround signals. It is therefore, simplification of its structure and processings can be achieved.

Also, in accordance with characteristics of the present invention, there is provided an apparatus for localizing a sound image, in which positions of the sound image reproduced by the left front and the right front signals are shifted by varying a ratio between the left front and the right front signals supplied to the left speaker and the right speaker and to the side localization means. In this way, a sense of the frontal width can be varied by adjusting the ratio.

Further, in accordance with characteristics of the present invention, there is provided an apparatus for localizing a sound image, in which the surround signal includes a surround left signal and a surround right signal. In this way, the "surround-effect" with higher realistic presence can be realized.

In accordance with characteristics of the present invention, there is provided an apparatus for localizing a sound image, in which a center signal is added to each of the left front signal and the right front signal, and both the left front and the right front signal adding the center signal are supplied to the left speaker and the right speaker. In this way, the "surround-effect" with realistic presence can be achieved without providing additional speakers.

Also, in accordance with characteristics of the present invention, there is provided an apparatus and a method for localizing a sound image, in which steps of generating a differential signal between the left front signal and the right front signal, obtaining a side signal responsive to a transfer function $H_s$ in accordance with the differential signal, obtaining a center monophonic signal by adding the left front signal and the right front signal, supplying a signal to one of the left speaker and the right speaker, the signal being generated by adding the center monophonic signal and the side signal, and supplying a signal to one of the left speaker and the right speaker, the signal being generated by subtracting the side signal from the center monophonic signal are carried out, wherein the transfer function is defined as an equation of $H_S=(h_{SS}-h_{SL})/(h_a-h_b)$, and wherein hss is equal to a transfer function from a speaker virtually localized at the right side to the right ear of the listener and a transfer function from a speaker virtually localized at the left side to the left ear of the listner, and wherein $h_{SL}$ is equal to a transfer function from a speaker virtually localized at the left side to the right ear of the listener and a transfer function from a speaker virtually localized at the right side to the left ear of the listener, and wherein $h_a$ is equal to a transfer function from the right speaker to the right ear of the listener and a transfer function from the left speaker to the left ear of the listener, and wherein $h_b$ is equal to a transfer function from the left speaker to the right ear of the listener and a transfer function from the right speaker to the left ear of the listener.

In this way, a sound field created with a monophonic-side method can be obtained using just two speakers. In addition, this can be achieved by using just one filter.

Further, in accordance with characteristics of the present invention, there is provided an apparatus for localizing a sound image, in which the output signal of the add result output means being calculated by adding the center monophonic signal, the output of the filtering means and the front right signal is provided to the left speaker, the output of the subtracting result output means being calculated by subtracting the output of the filtering means from the center monophonic signal and add the front left signal to the resulting signal is provided the right speaker. In this way, a wide frontal width can be secured regardless of the width defined between the speakers without making its structure complex.

In accordance with characteristics of the present invention, there is provided an apparatus for localizing a sound image, in which a ratio between the center monophonic signal, and one of the front right signal supplied to the add result output means and the front left signal supplied to the subtract result output means is varied. In this way, the frontal width can be shifted with an apparatus having a simple structure.

Also, in accordance with characteristics of the present invention, there is provided an apparatus and a method for localizing a sound image, in which steps of obtaining an add signal and a differential signal of a left front signal and a right front signal by carrying out coefficient processings to both the left front and the right front signals, and obtaining an add signal and a differential signal of a surround left signal and a surround right signal by carrying out coefficient processings to both the surround left and the surround right signal, and then supplying signals calculated by adding the signals thus obtained to the first filtering means and the second filtering means are carried out. Further, the add signal and the differential signal of both the first and second filtering means are defined as elements of the output signals. Both a signal respectively carried out coefficient processings to both the left front and the right front signal and a signal carried out coefficient processings to outputs of each delay means are defined as elements of the output signals. Further, outputs carried out coefficient processings to each outputs of the delay means are also defined as elements of the output signals. In this way, a desired sound reproduction method can be selected easily from various sound reproduction methods such as a monophonic-side reproduction method, or a 4-channel surround method (two sound image in front and two sound image in side) using two actual speakers.

Further, in accordance with characteristics of the present invention, there is provided an apparatus and a method for localizing a sound image, in which low frequency signals are added together after carrying out coefficient processings, and the resulting signals are filtered through high-pass filters in order to generate signals for the left speaker and the right speaker while generating a signal for a sub-woofer speaker through a low-pass filter.

In this way, low frequency signals can be reproduced with the sub-woofer speaker even when both the left and the right speakers have insufficient capability of reproducing low frequency signals.

In accordance with characteristics of the present invention, there is provided an apparatus for localizing a sound image, which comprises a center signal input terminal capable of supplying a center signal, a twelfth adding means for adding a signal carried out a coefficient processing using an eighth coefficient to the signal supplied through the center signal input terminal and the signal supplied through the left front signal input terminal, and an adding means for adding the signal carried out the coefficient processing using the coefficient to the signal supplied through the center signal input terminal and a signal supplied input through the right front signal input terminal, and an output of the adding means is supplied to the first delay means as an input thereof, and an output of the adding means is supplied to the second delay means as an input thereof.

In this way, the "surround-effect" with higher realistic presence can be realized without providing additional speakers.

While the novel features of the invention are set forth in a general fashion, both as to organization and content, the invention will be better understood and appreciated, along with other objects and features thereof, from the following detailed description taken in conjunction with the drawings.

DETAILED DESCRIPTION OF THE PREFERRED EMBODIMENT

Figure 1:
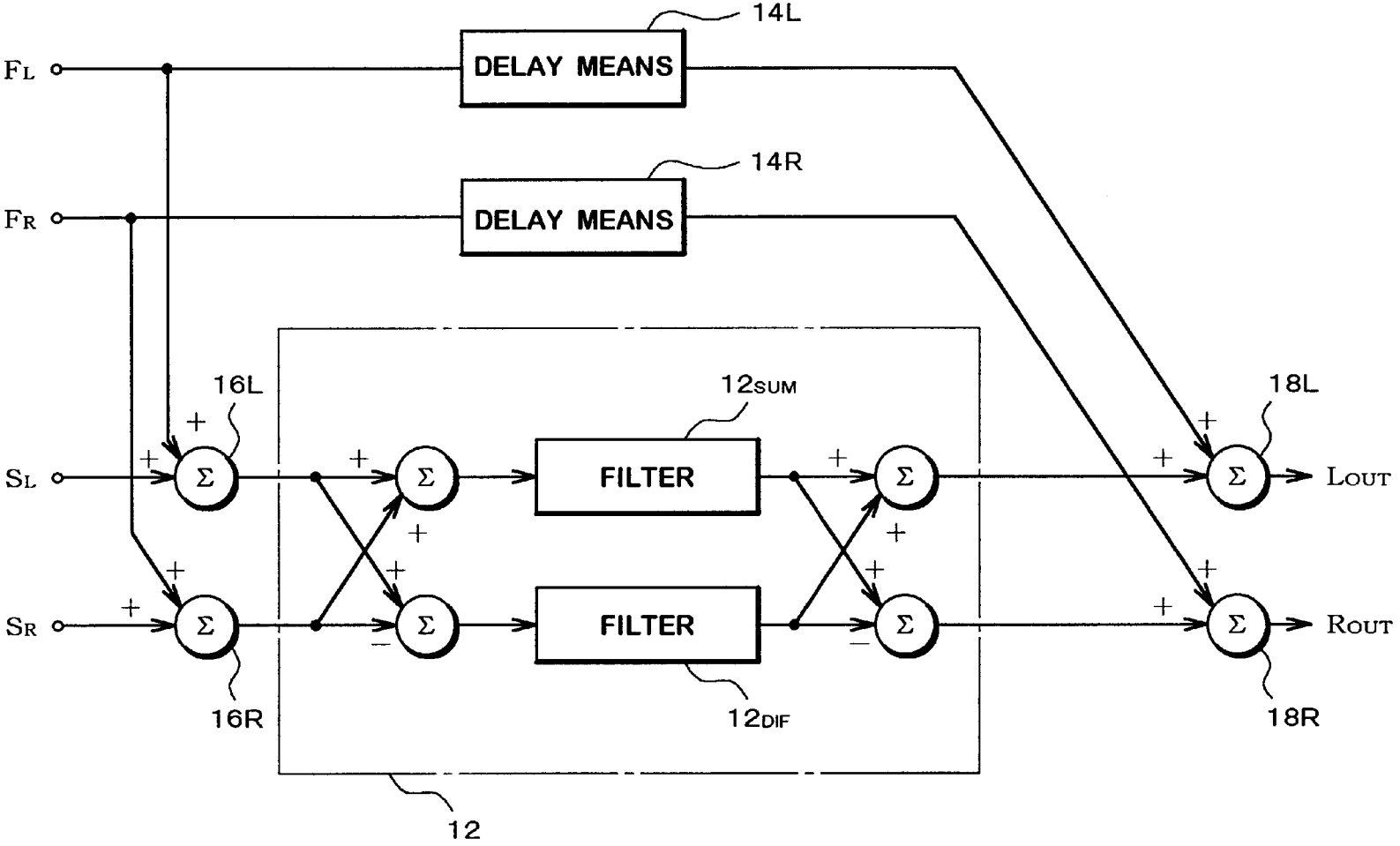
FIG. 1 is a block diagram illustrating an embodiment of an apparatus for localizing a sound image in accordance with the present invention.
Figure 2:
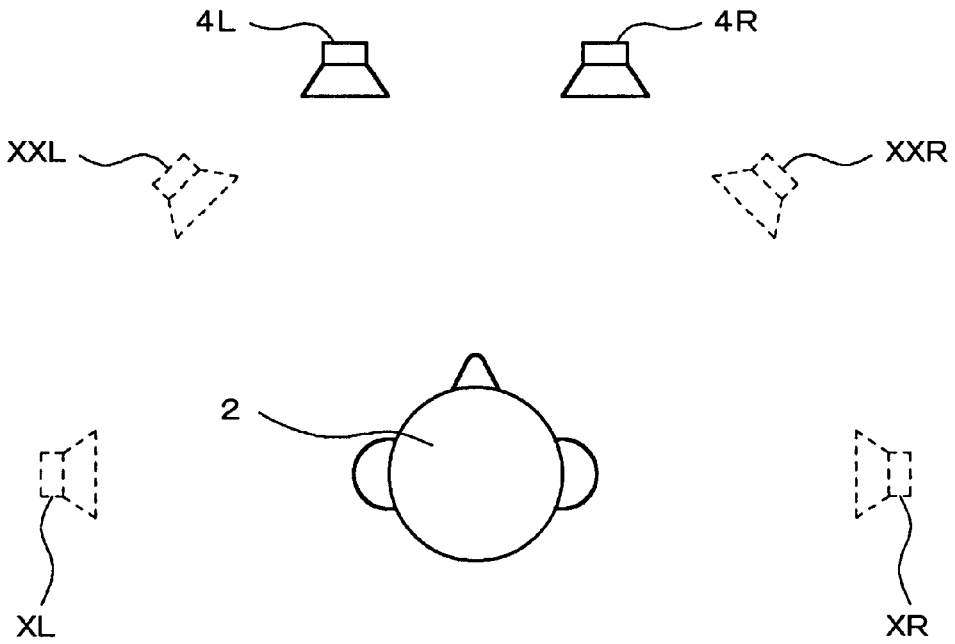
FIG. 2 is a view illustrating positions of the sound image reproduced by speakers both actually arranged and virtually localized with the apparatus shown in FIG. 1.

FIG. 1 is a block diagram illustrating an overall structure of an embodiment of an apparatus for localizing a sound image in accordance with the present invention. In the apparatus, signals $L_{OUT}$ and $R_{OUT}$ for speakers positioned both the left-hand and the right-hand in front of a listener are generated by inputting signals for left front FL, for right front FR, for surround left SL, and for surround right SR as input signals. Both the surround left signal SL and the surround right signal SR are supplied to means 12 for localizing the sound image to the sideward of the listener (hereinafter referred to as sideward localization means) including two filters (so called shuffler type filters). The sound image reproduced by the surround signals SR and SL can be localized to sidewards of the listener 2 as virtual speakers XL and XR as shown in FIG. 2 as a result of supplying outputs of the sideward localization means 12 to both speakers 4L and 4R.

On the other hand, both the left front signal FL and the right front signal FR are supplied to the speakers 4L and 4R after completing delay processings with delay means 14L and 14R. The delay means 14L is a means for providing a delay time equivalent to a delay caused by both the sideward localization means 12 and an adding means 16L. The other delay means 14R is a means for providing another delay time equivalent to a delay caused by both the sideward localization means 12 and an adding means 16R. By passing through both the delay means 14L and 14R, the delay arise between both the front left signal FL and the front right signal FR and both the surround left signal SL and the surround right signal SR can be compensated. As described above, the front left signal FL and the front right signal FR are given to the speaker 4L and the speaker 4R respectively, and a sound image is created at the positions of both the speakers 4L and 4R.

Further, both the front left signal FL and the front right signal FR are supplied to the sideward localization means 12 in the embodiment. In this way, the sound image reproduced by the front left signal FL is localized not only at the position of the speaker 4L, but also at the position of the virtual speaker XL. Consequently, the sound image reproduced by the front left signal FL is localized at a position XXL between the speaker 4L and the virtual speaker XL. Similar to the front left signal FL, the sound image reproduced by the front right signal FR is localized at a position XXR. As a result, localized positions of the sound image reproduced by both the front left signal FL and the front right signal FR can be located outwardly from the positions of the speakers 4L and 4R. In other words, the frontal width can be widen even when the width defined between the speakers 4L and 4R is narrow. The apparatus is able to realize the above-mentioned localization with a simple structure because the sideward localization means 12 is also used as a filter for carrying out the localizing processings for widening the frontal width.

Further, localized positions XXL (XXR) of the sound image reproduced by the front left signal FL (front right signal FR) can be shifted within an area defined between the speaker 4L (4R) and the virtual speaker XL (XR) by varying a ratio of the front left signal FL (the front right signal FR) supplied to the delay means 14L (14R), and that supplied to the sideward localization means 12.

Figure 3:
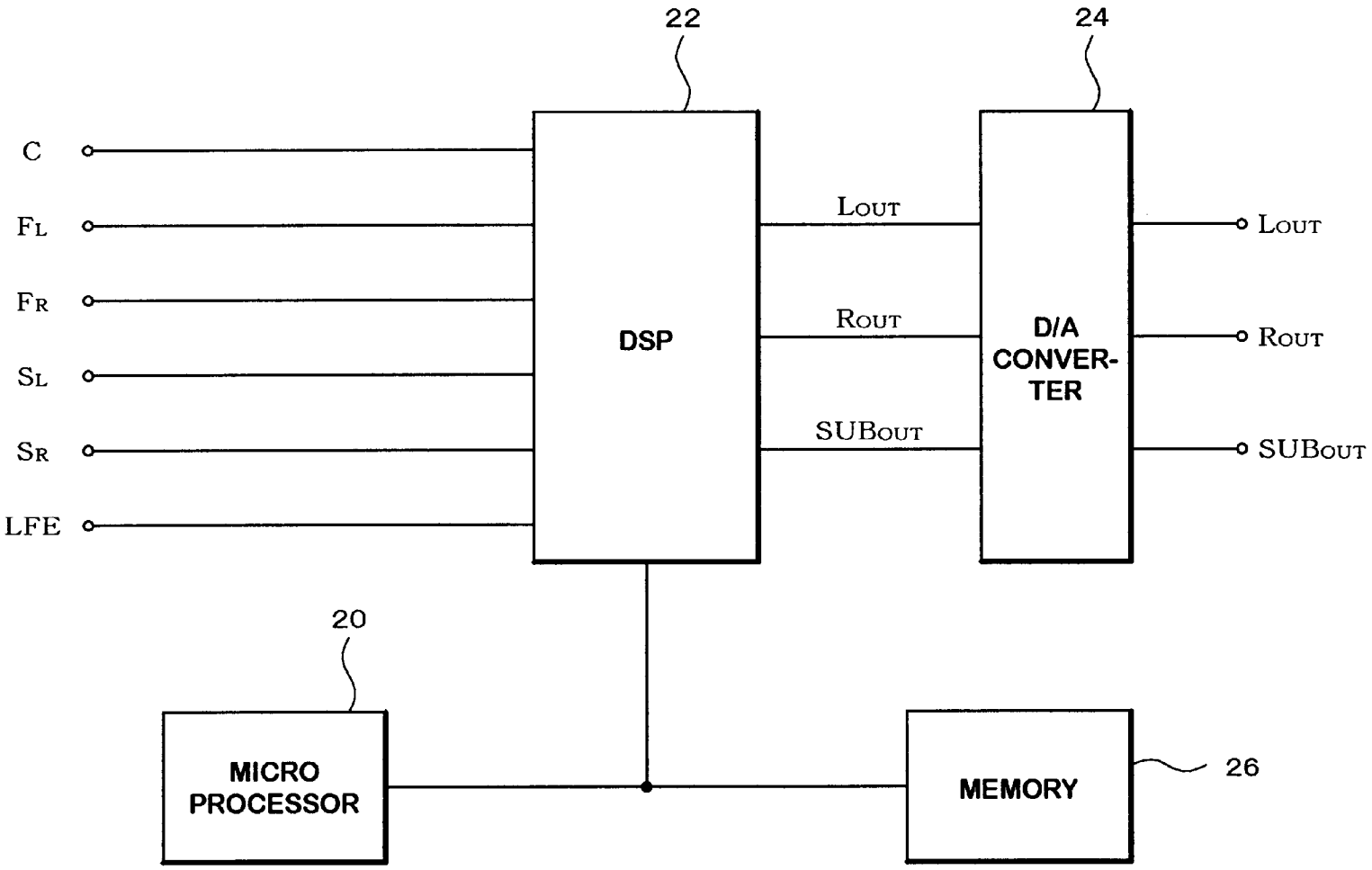
FIG. 3 is a hardware structure of the apparatus using a digital signal processor (hereinafter referred to as DSP) 22.

FIG. 3 is a hardware structure of the apparatus using a DSP 22. The apparatus is used to reproduce input signals that are center signal C, the front left signal FL, the front right signal FR, the surround left signal SL, the surround right signal SR, and a low frequency signal LFE with both the speakers 4L, 4R as well as a sub-woofer speaker 4S.

The input signals that are the center signal C, the front left signal FL, the front right signal FR, the surround left signal SL, the surround right signal SR, and the low frequency signal LFE are generated by decoding a digitized data converted from an analog signal with an analog-to-digital converter or a digital-bit-stream encoded for surround, with a multi-channel surround decoder (not shown). The input signals are supplied to the DSP 22. The multi-channel surround decoder can either be incorporated into the DSP or separately provided therefrom.

The signals $L_{OUT}$ and $R_{OUT}$ for the speakers positioned both the left-hand, the right-hand and a signal $SUB_{OUT}$ for the sub-woofer speaker are generated by performing processings such as addition, subtraction, filtering, delay and the like with the DSP 22 to the digital data thus input in accordance with program(s) stored in a memory 26. These signals thus generated are converted into analog signals with a digital-to-analog converter 24, and are supplied to the speakers 4L, 4R, and 4S. Installation process of the program (s) into the memory 26 and other processings are carried out by a micro-processor 20.

Figure 4:
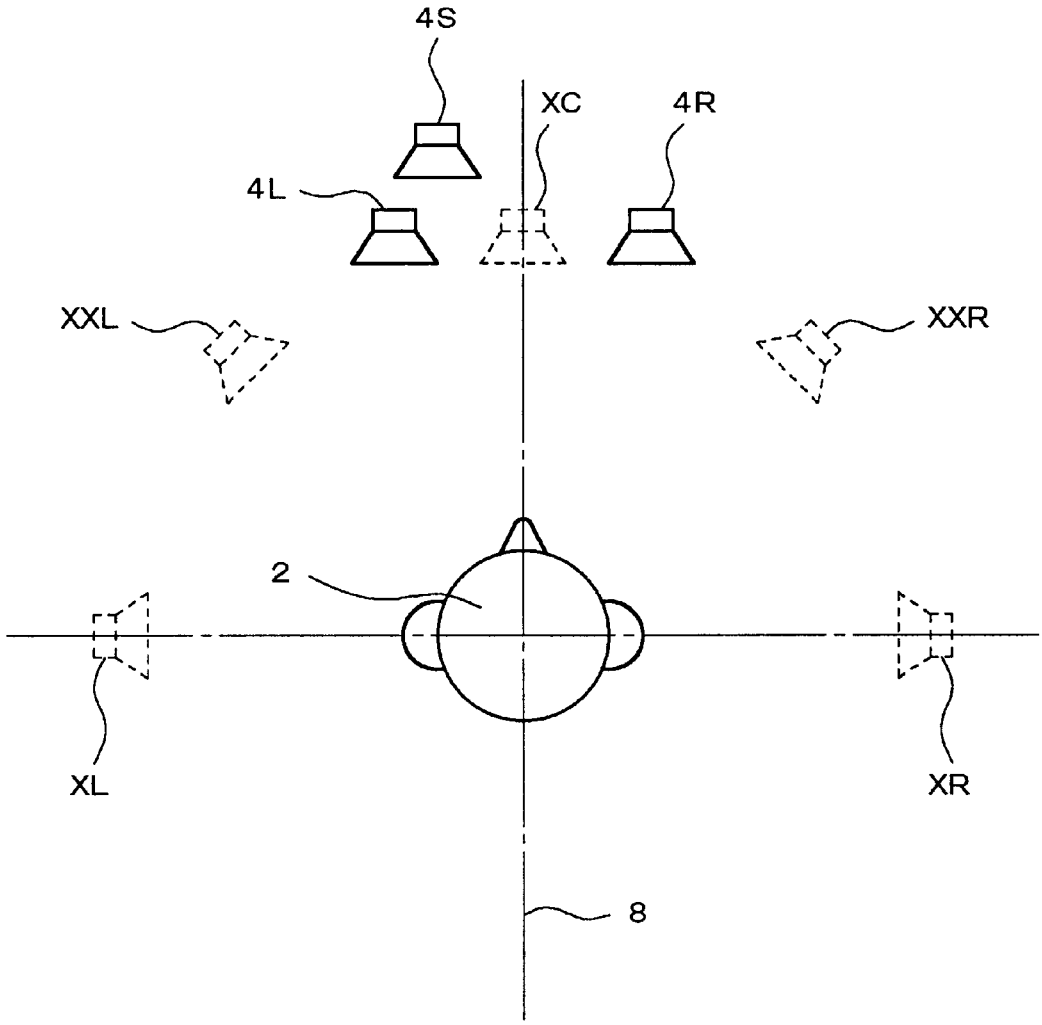
FIG. 4 is another view illustrating positions of the sound image reproduced by the speakers both actually arranged and virtually localized with processings shown in FIG. 5.

In this embodiment, it is presumed that the speakers 4L, 4R, and the virtual speakers XL, XR are symmetrically arranged with respect to the central axis 8 through the listener 2 as shown in FIG. 4. Both a weak directivity and a long wave length of bass (sound having a low frequency) reproduced by the woofer speaker 4S allow the woofer to be arranged at any location.

Figure 5:
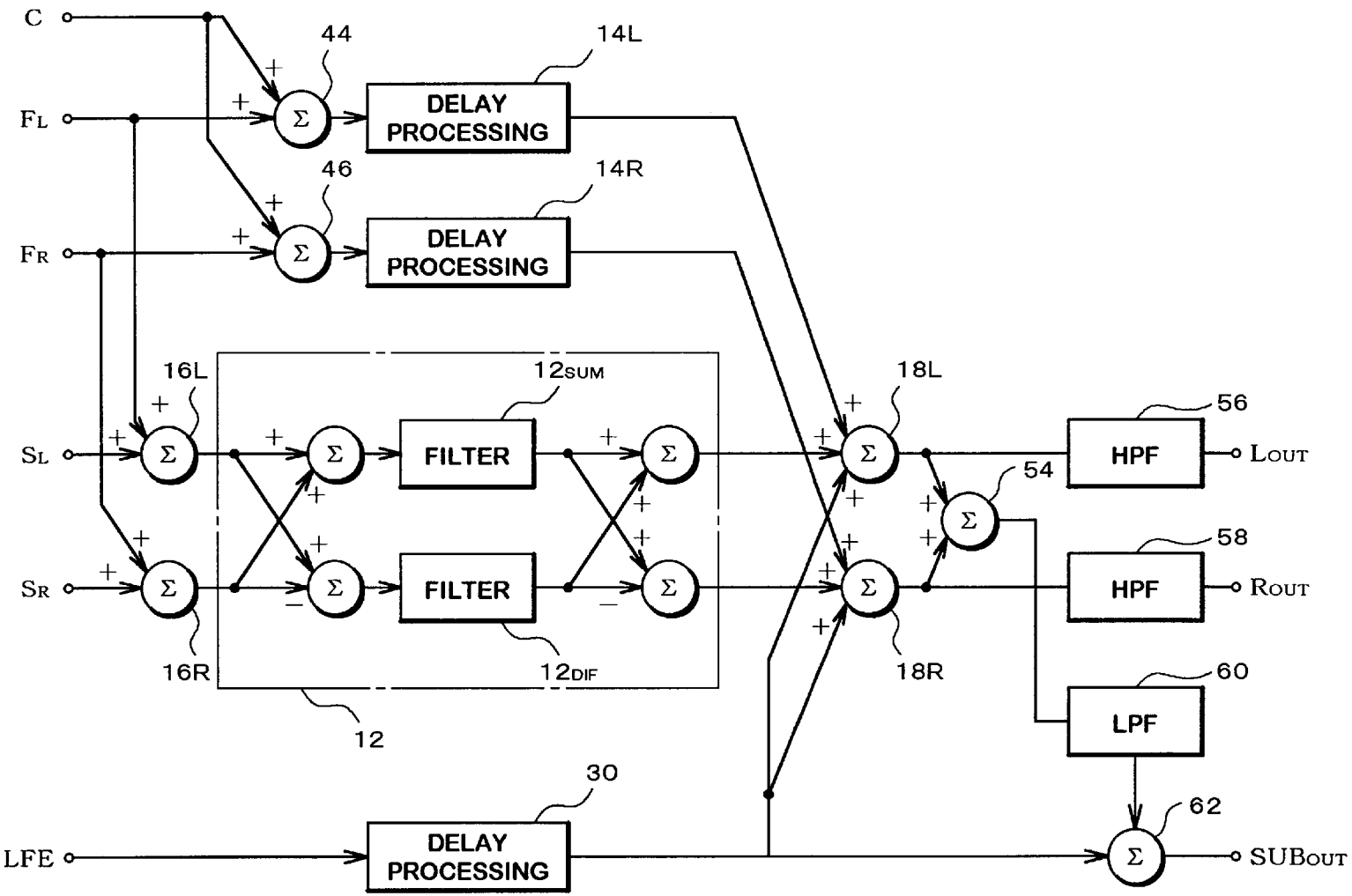
FIG. 5 is a signal-flow diagram illustrating processings carried out by the DSP 22 shown in FIG. 3.

FIG. 5 is a signal flow diagram illustrating processings carried out by the DSP 22 in accordance with the program(s) stored in the memory 26. The center signal C is added to both the front left signal FL and the front right signal FR through add processings 44 and 46 in this embodiment. In this way, the sound image reproduced by the center signal can be localized at a position XC shown in FIG. 4. Lack of sound image in center (a phenomenon such that the listener feel like insufficient sound is reproduced in center of the sound field) caused by widening the frontal width can be avoided by utilizing the sound image thus localized at the position XC. The localization is useful especially to a movie that reproduces important information such as voice of actor(s) in the center part thereof.

The low frequency signal LFE is added to both the left front signal FL and the right front signal FR after completion of a delay processing 30 for compensating a delay caused by both filters $12_{SUM}$, $12_{DIF}$ (see add processings 18L, 18R). Thereafter, both the front left signal FL and the front right signal FR are added with each other through an add processing 54, and only the bass part of the added signal is extracted with a low-pass filter 60. The signal $SUB_{OUT}$ for the woofer 4S is generated by adding (see an add processing 62) the output of the low pass filter 60 to the low frequency signal LFE being delayed in the delay processing 30.

In this embodiment, both the signals $L_{OUT}$ and $R_{OUT}$ for the speakers are generated by carrying out high pass-filter processings 56, 58 in order to eliminate the bass part.

In this way, a sound field with realistic presence is created with the woofer 4S even when the speakers 4L, 4R reproduce the bass part insufficiently.

Another embodiment of the apparatus realizing localization of virtual speakers XM, XL, and XR required for stereophonic reproduction using a monophonic-side reproduction method (so called M-S method) will be described. In the apparatus, both the signals $L_{OUT}$ and $R_{OUT}$ for the speakers 4L, 4R are generated from both the left front signal FL and the right front signal FR in order to localize the sound image at the positions of the virtual speakers XM, XL, and XR shown in FIG. 6. It is also presumed that the speakers 4L, 4R, and the virtual speakers XL, XR are symmetrically arranged with respect to the central axis 8 through the listener 2.

Figure 7:
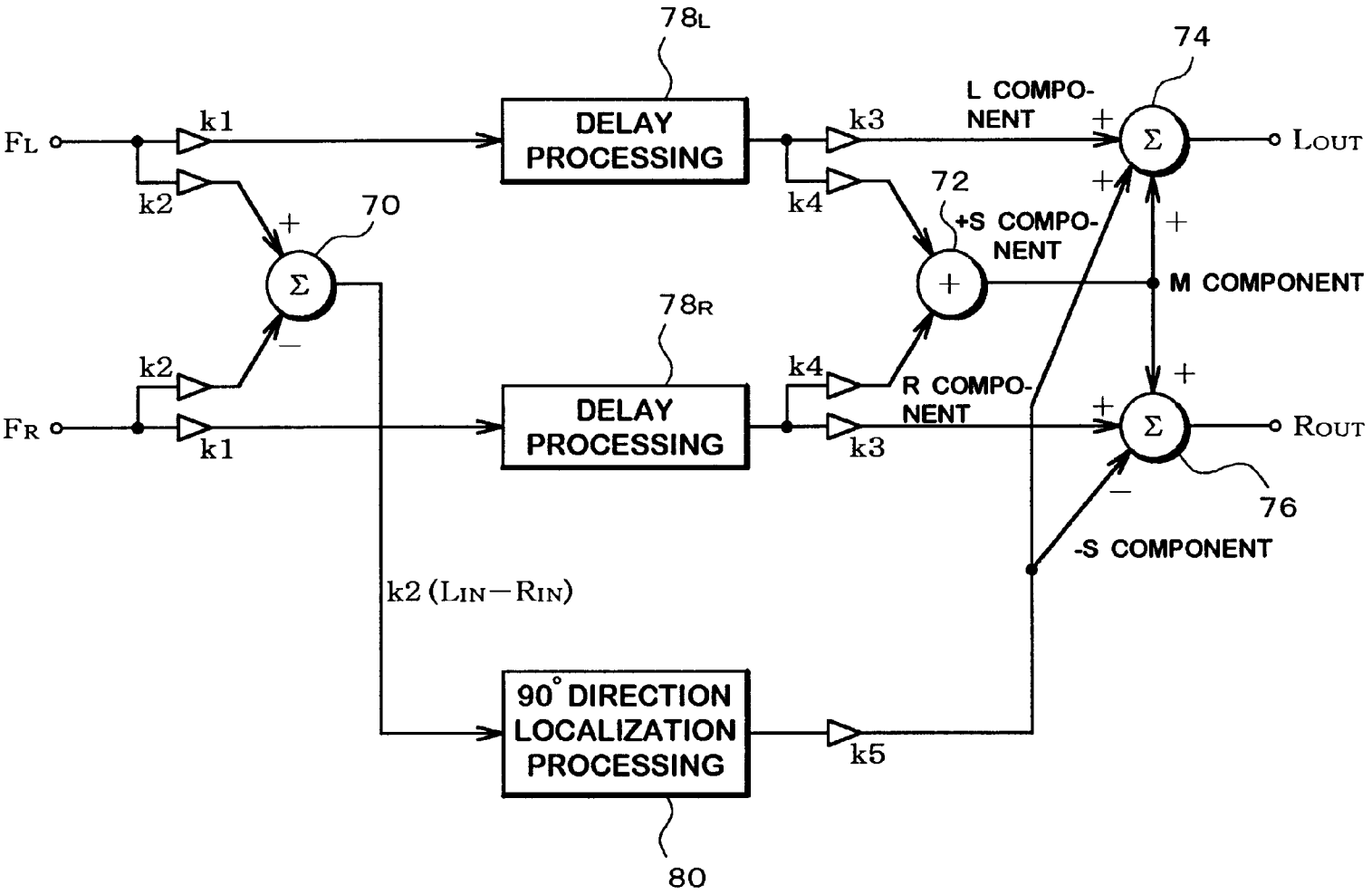
FIG. 7 is a signal-flow diagram illustrating the processings carried out by the DSP 22 used in another embodiment.

The hardware structure of the apparatus using the DSP 22 is similar to that of shown in FIG. 3, but the signals such as the center signal C, the surround left signal SL, the surround right signal SR, and the low frequency signal LFE may be supplied to the apparatus as necessary. FIG. 7 is a signal-flow diagram illustrating the processings carried out by the DSP 22 according to the program(s) stored in the memory 26.

A differential signal of the left front signal FL and the right front signal FR is calculated in a subtract processing 70. The differential signal is filtered by a 90° direction localization processing 80 acting as a filtering means. As a result of filtering, an S component is figured out. In order to compensate a delay of the filtered signal caused by the 90° direction localization processing 80, delay processings 78L, 78R are carried out respectively to the left front signal FL and the right front signal FR. On completion of the delay processings, an M component (a monophonic component in center) is generated as a result of adding both the left front signal FL and the right front signal FR carried out in an add processing 72.

The M component thus generated and the S component are added in an add processing 74 so as to obtain the signal $L_{OUT}$ for the left speaker 4L. Further, the S component is subtracted from the M component in a subtract processing 76 so as to obtain the signal $R_{OUT}$ for the right speaker 4R. A sound image reproduced by the M signal is localized at a position XM between the speaker 4L and the speaker 4R, and the sound image reproduced by the S and −S components are respectively localized at positions XL and XR, each positioned at the left and the right side of the listener 2. In this way, stereophonic reproduction with surround effect using the M-S method can be realized by just utilizing two speakers 4L, 4R.

Further, the reason for feasibility of the processings described above by using only one 90° direction localization processing 80 (the filtering means) is as the following.

Figure 6:
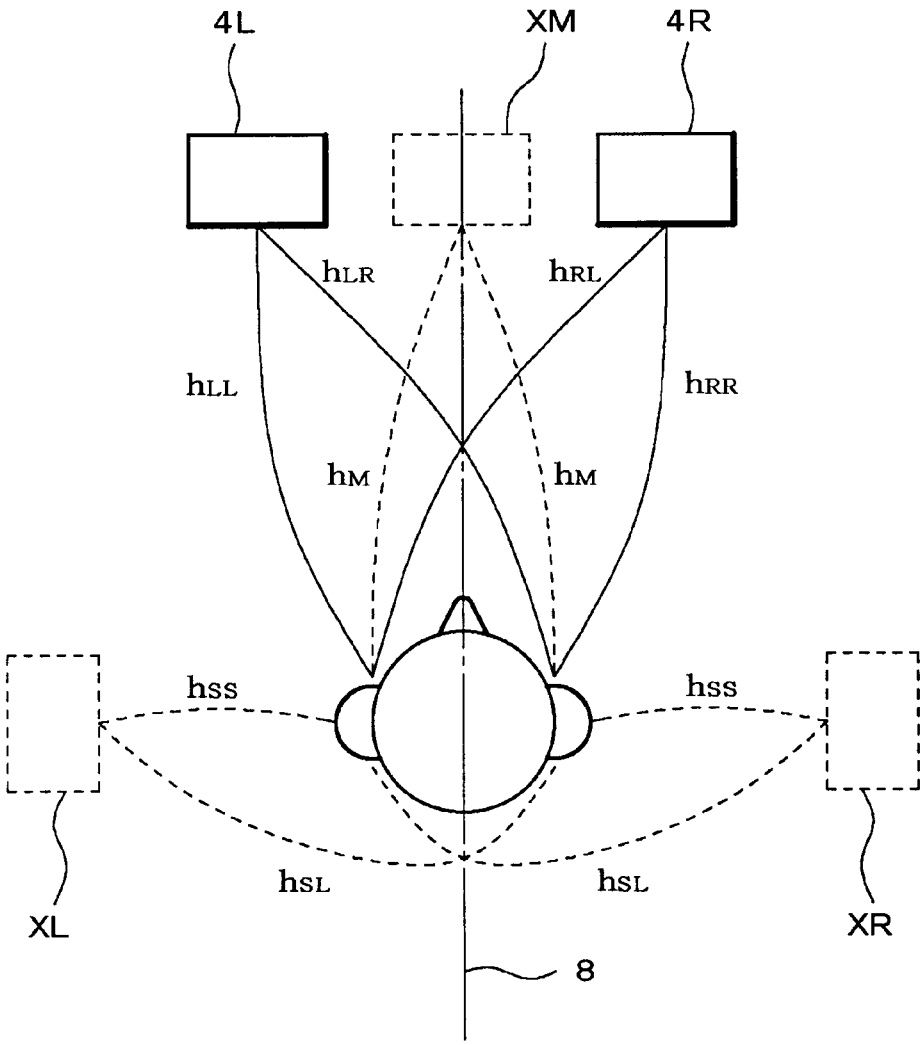
FIG. 6 is another view illustrating position of the sound image reproduced by the speakers both actually arranged and virtually localized with the processings shown in FIG. 7.

Assuming equations $h_a=h_{LL}=h_{RR}$, $h_b=h_{LR}=h_{RL}$ are satisfied, and the transfer functions $H_{MS}$ of the 90° direction localization processing 80 is defined as the followings in FIG. 6:

$$(H_{MS}) = \begin{pmatrix} H_M & 0 \\ 0 & H_S \end{pmatrix}$$

And the signals M, S are defined to the left front signal FL and the right front signal FR by:

$$\begin{pmatrix} M \\ S \end{pmatrix} = \frac{1}{2}\begin{pmatrix} 1 & 1 \\ 1 & -1 \end{pmatrix}\begin{pmatrix} L_{IN} \\ R_{IN} \end{pmatrix}$$

The equation shown below may be satisfied to carry out the localization in the M-S method.

$$\begin{pmatrix} h_M & h_{SS}-h_{SL} \\ h_M & -(h_{SS}-h_{SL}) \end{pmatrix}\begin{pmatrix} M \\ S \end{pmatrix} = \begin{pmatrix} h_a & h_b \\ h_b & h_a \end{pmatrix}\begin{pmatrix} 1 & 1 \\ 1 & -1 \end{pmatrix}\begin{pmatrix} H_M & 0 \\ 0 & H_S \end{pmatrix}\begin{pmatrix} M \\ S \end{pmatrix}$$

Wherein $[H_{MS}]$ can be figured out by calculating the equation shown below when a result of $h_a^2-h_b^2$ is not zero.

$$\begin{pmatrix} H_M & 0 \\ 0 & H_S \end{pmatrix} = \begin{pmatrix} h_a & h_b \\ h_b & h_a \end{pmatrix}^{-1}\begin{pmatrix} h_M & h_{SS}-h_{SL} \\ h_M & -(h_{SS}-h_{SL}) \end{pmatrix}$$

Solving the above equation, the solution is yielded:

$$H_M = \frac{h_M}{h_a + h_b},\ H_S = \frac{h_{SS}-h_{SL}}{h_a - h_b}$$

Wherein $h_M$, $h_a$ and $h_b$ are considered to be equal when the speakers 4L, 4R are arranged in a short distance, so that $H_M$ can be defined as ½. In this way, the processings described above can be realized by using only one 90° direction localization processing 80 (the filtering means) having a transfer function of $H_S$.

As described above, the stereophonic reproduction using the M-S method can be realized using just one filtering means with two speakers 4L, 4R according to this embodiment. In this way, simplification of the circuit can be achieved when the filtering means is composed of a hardware and simplification of the processings can be achieved when the filtering means is composed of the DSP.

Further, both the front left signal FL and the front right signal FR carried out the delay processings 78L, 78R are added to the output signals $L_{OUT}$, $R_{OUT}$ respectively with a predetermined coefficient k3 as shown in FIG. 7. Thus, a sense of the frontal width can be varied by adjusting value of the coefficient k3.

Although, the processings shown in FIG. 7 are carried out with the DSP 22 in the embodiment described above, these processings can be carried out with hardware circuit(s) as well.

Figure 8:
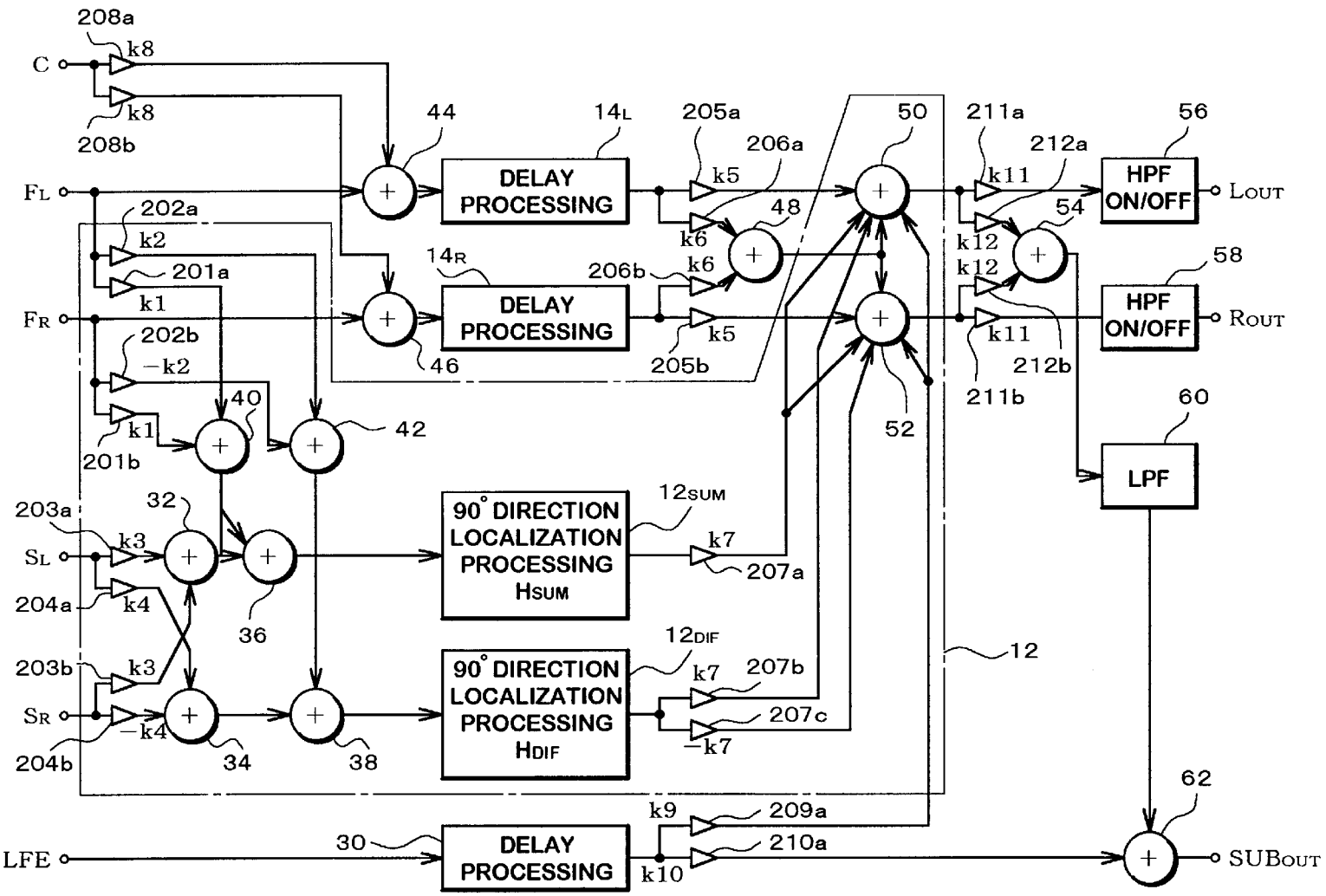
FIG. 8 is a signal-flow diagram illustrating the processings carried out by the DSP 22 used in still another embodiment.

Another embodiment of the apparatus will be described. The hardware structure of the apparatus is similar to that shown in FIG. 3. FIG. 8 is a signal-flow diagram illustrating processings carried out by the DSP 22 in accordance with the program(s) stored in the memory 26.

In FIG. 8, the center signal C carrying out coefficient processings 208*a*, 209*b* are added to the front left signal FL and the front right signal FR (add processings 44, 46). Predetermined coefficients in a range of 0 to 1 is multiplied to the signal in the coefficient processings 208*a*, 209*b* (hereinafter, the same procedure shall be applied).

The outputs from the add processings 44 and 46 are supplied to the delay means 14L and 14R. In order to compensate a delay of both the surround signals SL and SR caused by the 90° direction localization processing, delay processings are carried out with the delay means 14L and 14R. The delay processings can easily be realized by storing a data into the memory 26 with the DSP 22 or internal memory of the DSP 22, then reading out the data after the passage of a delay time.

The outputs of both the delay means 14L and 14R are supplied to add processings 50, 52 as a second output element after carrying out coefficient processings 205*a*, 205*b* in which a coefficient k5 is respectively multiplied to the outputs. Another coefficient k6 is respectively multiplied to the outputs of the delay means 14L and 14R in coefficient processings 206*a*, 206*b*, and the outputs are supplied to the add processings 50, 52 as a third output element.

Both the front left signal FL and the front right signal FR are added in an add processing 42 after completing coefficient processings 202*a*, 202*b* in which coefficients k2, −k2 are respectively multiplied to the signals FL, FR. Phase of the signal is inverted when a coefficient having the sign of negative is multiplied to the signal. It is therefore, a differential signal of the left front signal FL and the right front signal FR is eventually calculated in the add processing 42.

Both the surround left signal SL and the surround right signal SR are added in an add processing 34 after completing coefficient processings 204*a*, 204*b* in which coefficients k4, −k4 are respectively multiplied to the surround signals SL, SR. Both the outputs of the add processing 34 and that of the add processing 42 are added in an add processing 38, and the resulting outputs are supplied to a 90° direction localization processing 12 $_{DIF}$.

Both the front signals FL, FR are added in an add processing 40 after completing coefficient processings 201*a*, 201*b* in which another coefficient k1 is respectively multiplied to signals FL, FR.

Further, both the surround signals SL, SR are added in an add processing 32 after completing coefficient processings 203*a*, 203*b* in which another coefficient k3 is respectively multiplied to the surround signals SL, SR. Both the outputs of the add processing 32 and that of the add processing 40 are added in an add processing 36, and the resulting outputs are supplied to another 90° direction localization processing 12 $_{SUM}$.

Filtering processings having respective transfer functions $H_{SUM}$, $H_{DIF}$ as defined below are carried out with both the 90° direction localization processing 12 $_{SUM}$ and the 90° direction localization processing 12 $_{DIF}$. The sound image reproduced by both the virtual speaker XL, XR can be localized to the positions located sidewardly in 90 degrees with respect to the central axis 8 of the listener 2. The transfer functions $H_{SUM}$, $H_{DIF}$ are defined as the followings.

$$H_{SUM}=(h_{a'}+h_{b'})/(h_a+h_b)$$

$$H_{DIF}=(h_{a'}-h_{b'})/(h_a-h_b)$$

wherein the equations $h_a=h_{LL}=h_{RR}$, $h_b=h_{LR}=h_{RL}$, $h_a'=h_{L'L}=h_{R'R}$, $h_b'=h_{L'R}=h_{R'L}$ are satisfied.

Another coefficient k7 is multiplied to the output of the 90° direction localization processing 12 $_{SUM}$ in a coefficient processing 207*a*, and the resulting output is supplied to both the add processings 50, 52 as a first output element. Further, the coefficient k7 and another coefficient −k7 are respectively multiplied to the outputs of the 90° direction localization processing 12 $_{DIF}$ in coefficient processings 207*b*, 207*c*, and the resulting outputs are respectively supplied to the add processings 50, 52 as the first output element.

The low frequency signal LFE is supplied to both the add processings 50, 52 after completing an add processing 209*a* in which another coefficient k9 is multiplied to the signal LFE, after carrying out the delay processing 30.

The outputs of the add processings 50, 52 are supplied to the high-pass filter processings 56, 58 after completing coefficient processings 211*a*, 211*b* in which another coefficient k11 is respectively multiplied to the outputs. Operation of the high-pass filter processings 56, 58 can be selected either of ON state or OFF state (that is, operated as a high-pass filter, or pass through the signals).

The outputs of the high-pass filter processings 56, 58 are output to output terminals as the left speaker signal $L_{OUT}$ and the right speaker signal $R_{OUT}$.

Meanwhile, the outputs of the add processings 50, 52 are added with each other in the add processing 54 after completing coefficient processings 212*a*, 212*b* in which another coefficient k12 is respectively multiplied to the outputs. The output of the add processing 54 is supplied to the low-pass filter processing 60.

The output of the low-pass filter processing 60 is added to a signal which multiplying a coefficient k10 to the output of the delay processing 30 (a coefficient processing 210*a*) in the add processing 62. The output of the add processing 62 is output to an output terminal as the woofer signal $SUB_{OUT}$.

A desired sound reproduction method/surround-effect can be selected easily from various sound reproduction methods and surround-effects by adjusting values of the coefficients while using only one apparatus, according to an embodiment shown in FIG. 8.

The values of the coefficients k1 through k12 shown in FIG. 8, and the sound reproduction methods/sound image localization realized by adjusting these coefficients will be described hereunder.

In the case of realizing a two channel stereophonic reproduction system using two speakers 4L, 4R (the woofer speaker 4S may also used as necessary) is described. In this case, the signals input to the system are both the front left signal FL and the front right signal FR. An ordinary two channel system is realized when values of the coefficients k1, k2, k3, k4, k6, k7, k8, k9 and k10 are set at values substantially zero as well as setting values of both the coefficients k5 and k11 at values substantially not zero. In this case, the sound image can be localized to the positions 4L, 4R shown in FIG. 4.

Figure 9:
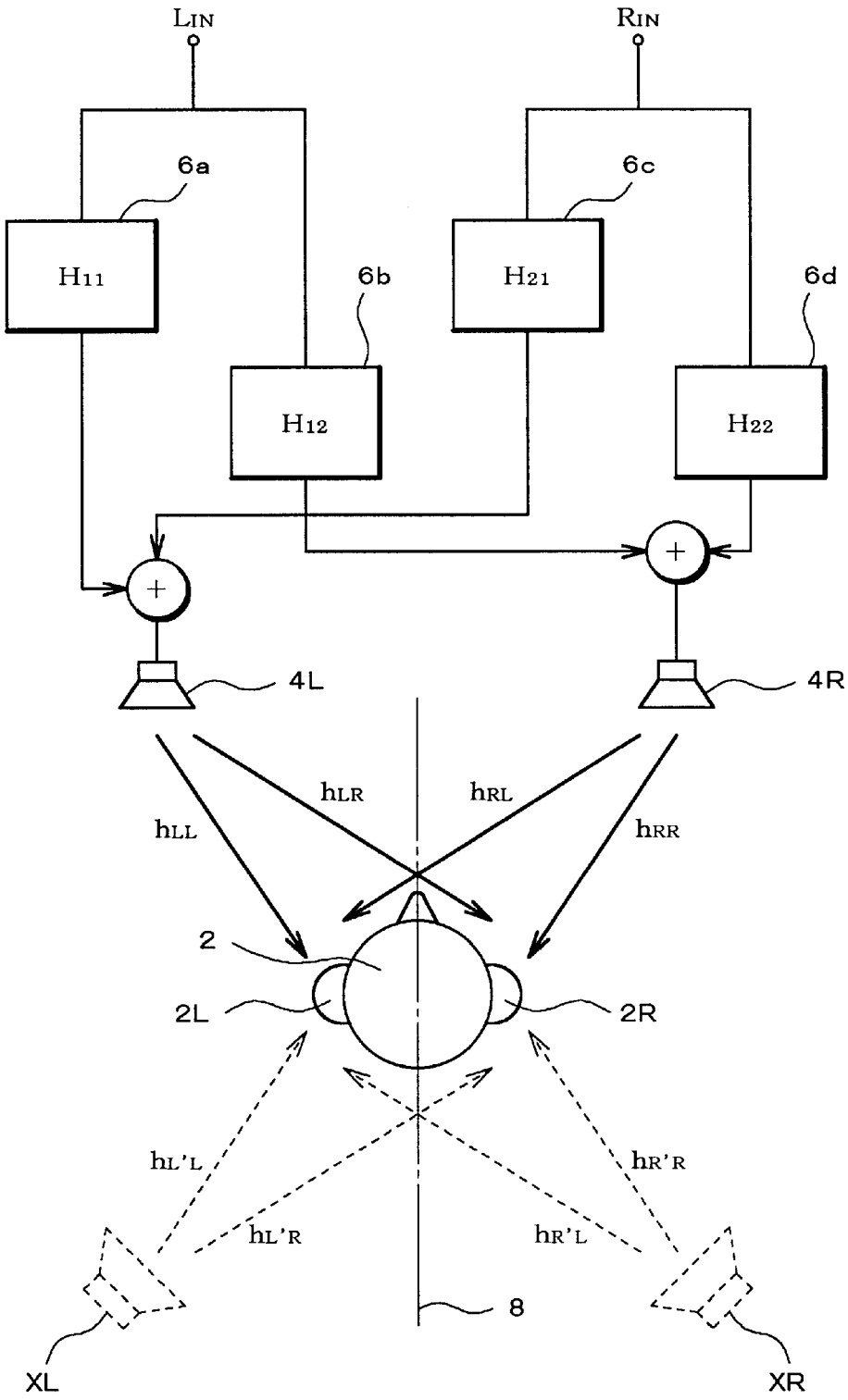
FIG.9 (PRIOR ART)
FIG. 9 is a schematic view illustrating a sound image localization (so called "lattice type") apparatus according to the prior art.
Figure 10:
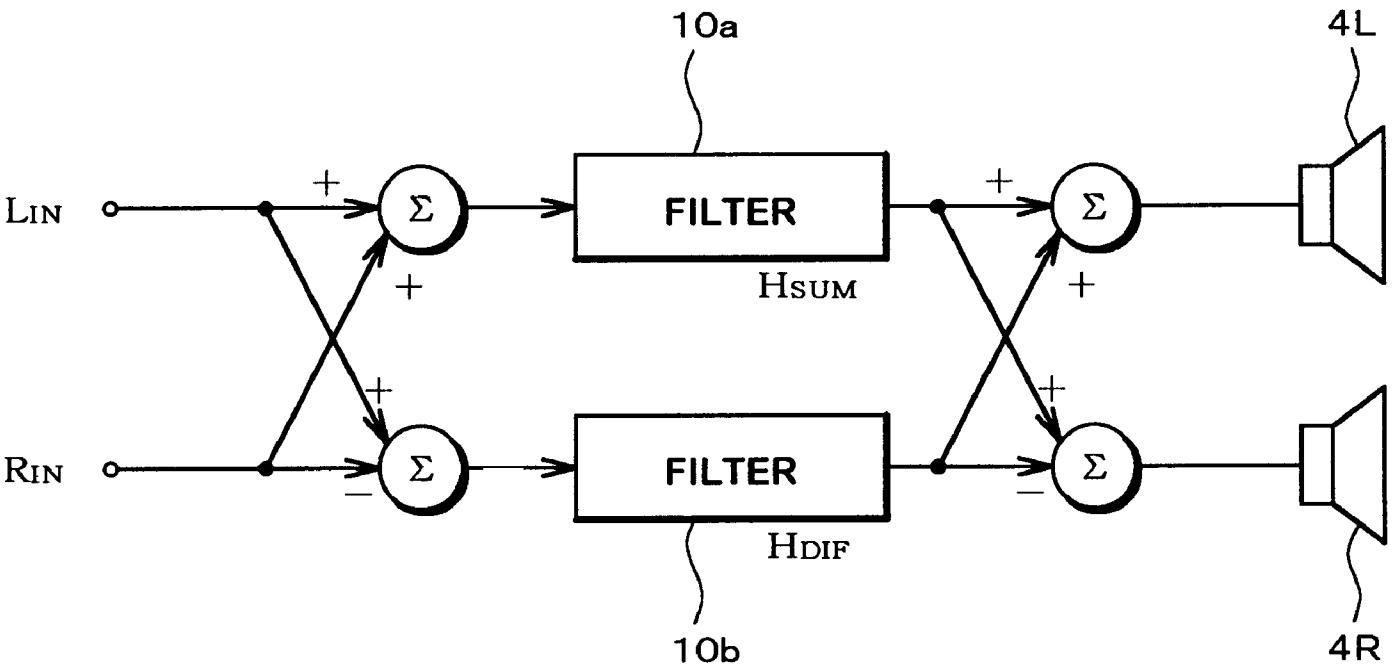
FIG.10 (PRIOR ART)
FIG. 10 is a block diagram illustrating the sound image localization (so called "shuffler type") apparatus according to the prior art.

Also, the sound image can be localized to the positions of the virtual speakers XL, XR shown in FIG. 9 when the values of the coefficients k3, k4, k5, k6, k8, k9 and k10 are set at values substantially zero as well as setting the values of the coefficients k1, k2, k7 and k11 at values substantially not zero.

Further, the sound image can be localized to the positions of the virtual speakers XXL, XXR shown in FIG. 4 when the values of the coefficients k3, k4, k6, k8, k9 and k10 are set at values substantially zero as well as setting the values of the coefficients k1, k2, k5, k7 and k11 at values substantially not zero. In this case, the position of the sound image can be shifted by adjusting the value of the coefficient k5.

Another stereophonic reproduction using the M-S method shown in FIG. 6 is realized when the values of the coefficients k1, k3, k4, k5, k8, k9 and k10 are set at values substantially zero as well as setting the values of the coefficients k2, k6, k7 and k11 at values substantially not zero.

Further, still another stereophonic reproduction system in the M-S method shown in FIGS. 6 and 7 can be realized when the values of the coefficients k1, k3, k4, kB, k9 and k10 are set at values substantially zero as well as setting the values of the coefficients k2, k5, k6, k7 and k11 at values substantially not zero. In the system, the sound image can be localized to the positions where the speakers 4L, 4R being arranged.

In any of the above cases, the value of the coefficient k12 should not be set at a value substantially zero when the woofer speaker 4S is used.

Next, the case of realizing reproduction of a 4 ch. surround sound system using two speakers 4L, 4R (the woofer speaker 4S is used as necessary) is described. The signals input to the system are the front left signal FL, the front right signal FR and the surround left signal SL and the surround right signal SR.

A surround sound reproduction method in which the front left signal FL is localized to the speaker 4L, the front right signal FR is localized to the speaker 4R, the surround left signal SL is localized to the virtual speaker XL and the surround right signal SR is localized to the virtual speaker XR, can be realized when the values of the coefficients k1, k2, k6, k8, k9 and k10 are set at values substantially zero as well as setting the values of the coefficients k3, k4, k5, k7 and k11 at values substantially not zero.

Another 4 ch. surround sound system shown in FIGS. 1, 2 can be realized when the values of the coefficients k6, k8, k9 and k10 are set at values substantially zero as well as setting the values of the coefficients k1, k2, k3, k4, k5, k7 and k11 at values substantially not zero. In this case, the localized positions XXL and XXR of the sound image reproduced by both the front left signal FL and the front right signal FR can be shifted by adjusting values of both the coefficients k2, k5.

In any of the above cases, the value of the coefficient k12 should not be set at a value substantially zero when the woofer speaker 4S is used.

Next, the case of using both the center signal C and the low frequency signal LFE in addition to the above-described 4 ch. surround sound systems will be described.

A 5.1 ch. surround sound system in which a sound image reproduced by input signals is respectively localized to the positions of the speakers 4R, 4L and 4S as well as that of the virtual speakers XC, XL and XR shown in FIG. 4 can be realized when the values of the coefficients k1, k2, k6, k9 and k12 are set at values substantially zero as well as setting the values of the coefficients k3, k4, k5, k7, k8, k10 and k11 at values substantially not zero.

Another 5.1 ch. surround sound system in which a sound image reproduced by the input signals is respectively localized to the positions of speaker 4S as well as that of the virtual speakers XC, XXL, XXR, XL and XR shown in FIG. 4 can be realized when the values of the coefficients k6, k9 and k12 are set at values substantially zero as well as setting the values of the coefficients k1, k2, k3, k4, k5, k7, k8, k10 and k11 at values substantially not zero.

A 5.0 ch. surround sound system without woofer speaker 4S in which a sound image reproduced by input signals is respectively localized to the positions of the speakers 4L, 4R and that of the virtual speakers XC, XL and XR shown in FIG. 4 can be realized when the values of the coefficients k1, k2, k6, k10 and k12 are set at values substantially zero as well as setting the values of the coefficients k3, k4, k5, k7, k8, k9 and k11 at values substantially not zero.

Although, localization of the sideward localization means 12 is directed in 90 degrees with respect to the central axis 8 of the listener 2 in the embodiments described above, the localization can be other degrees as long as the localized positions are located sideward of the listener. Also, a plurality of filters (so called shuffler type filters) are used for the sideward localization means 12, other type of filters (so called lattice type filters) can be used as well. Although, the structure of the system becomes complex when the lattice type filters are used, the use of the lattice type filters eliminates a restriction of the symmetrical arrangement of the speakers with respect to the central axis 8.

Although, the coefficients k2, −k2 are used for respectively carrying out the coefficient processings 202*a* and 202*b*, the coefficients −k2, k2 can be used for respectively carrying out the coefficient processings 202*a* and 202*b*. In that case, it is necessary to inverse the sign of the coefficient k4 as well as interchanging the 90° direction localization processing $\mathbf{12}_{SUM}$ with the 90° direction localization processing $\mathbf{12}_{DIF}$, in addition, it is necessary to invert the signs of relevant coefficient processings carried out later on.

Although, the DSP 22 is used in the above embodiments, the processings shown in FIG. 5 can be carried out with hardware circuit(s).

While the invention has been described in its preferred embodiments, it is to be understood that the words which have been used are words of description rather than limitation and that changes within the purview of the appended claims can be made without departing from the true scope and spirit of the invention in its broader aspects.

What is claimed is:

1. An apparatus for localizing a sound image reproduced with a pair of speakers arranged at positions left and right front of a listener so as to make the listener feel like surrounded by the sound image, the sound image being reproduced in accordance with at least a left front signal, a right front signal and a surround signal, each of the signals being input to the apparatus, the apparatus comprising:

a side localization means, that receives the surround signal, for outputting a signal for localizing the sound image of the surround signal at positions sideward of the listener to the left speaker and the right speaker, and a delay means, that receives the left front and right front signals, for carrying out a delay processing for equalizing a delay time of the left front and the right front signals with a delay time caused by the side localization means, and for outputting the left front and the right front signals being delayed respectively to the left speaker and the right speaker, wherein both the left front and right front signals are further supplied to the side localization means, so as to localize sound image between the left speaker and the left side of the listener and sound image between the right speaker and the right side of the listener.

2. The apparatus in accordance with claim 1, wherein positions of the sound images reproduced by the left front and the right front signals are shifted respectively by varying a ratio between front signals supplied to the delay means and the front signals supplied to the side localization means.

3. The apparatus in accordance with claim 1, wherein the surround signal includes a surround left signal and a surround right signal.

4. The apparatus in accordance with claim 1, wherein a center signal is added to each of the left front signal and the right front signal, and wherein both the left front and the right front signal to which the center signal has been added are supplied to the delay means.

5. A method for localizing a sound image reproduced with a pair of speakers arranged at positions left and right front of a listener so as to make the listener feel like surrounded by the sound image, the sound image being reproduced in accordance with at least a left front signal, a right front signal and a surround signal, the method comprising the steps of:

outputting a signal to the left speaker and the right speaker respectively, the signal being generated by carrying out localization processing for localizing the sound images of the surround, the left front and the right front signals at positions sideward of the listener, and delay processing for equalizing a delay time of the left front and right front signals with a delay time caused by the side localization, and outputting the delayed left front and right front signals respectively to the left speaker and the right speaker.

6. An apparatus for localizing a sound image reproduced with a pair of speakers arranged at positions left and right front of a listener so as to make the listener feel like surrounded by the sound image, the sound image being reproduced in accordance with at least a left front signal and a right front signal, each of the signals being input to the apparatus, the apparatus comprising:

a differential signal generating means for generating a differential signal between the left front signal and the right front signal, a filtering means for outputting an output generated by filtering the differential signal inputted from the differential signal generating means in accordance with a transfer function $H_S$, a first delay means for providing a delay equivalent to a delay time caused by the filtering means to the right front signal, a second delay means for providing the delay equivalent to the delay time caused by the filtering means to the left front signal, a center monophonic signal generating means for generating a center monophonic signal by adding an output of the first delay means and that of the second delay means, an add result output means for outputting a signal to be provided to one of the left speaker and the right speaker, the signal being generated by adding the output of the filtering means to the center monophonic signal, and a subtract result output means for generating a signal to be provided to one of the left speaker and the right speaker, the signal being generated by subtracting the output of the filtering means from the center monophonic signal, wherein the transfer function is defined as an equation of $H_S=(h_{SS}-h_{SL})/(h_a-h_b)$, and wherein $h_{SS}$ is equal to a transfer function from a speaker virtually localized at the right side to the right ear of the listener and a transfer function from a speaker virtually localized at the left side to the left ear of the listener, and wherein $h_{SL}$ is equal to a transfer function from a speaker virtually localized at the left side to the right ear of the listener and a transfer function from a speaker virtually localized at the right side to the left ear of the listener, and wherein $h_a$ is equal to a transfer function from the right speaker to the right ear of the listener and a transfer function from the left speaker to the left ear of the listener, and wherein hb is equal to a transfer function from the left speaker to the right ear of the listener and a transfer function from the right speaker to the left ear of the listener.

7. The apparatus in accordance with claim 6, wherein the output of the first delay means is provided to the add result output means, and wherein an output signal of the add result output means is calculated by adding the output of the first delay means, the center monophonic signal and the output of the filtering means, and wherein the output of the second delay means is provided to the subtract result output means, and wherein an output signal of the subtract result output means is calculated by adding the output of the second delay means to a result of subtracting the output of the filtering means from the center monophonic signal.

8. The apparatus in accordance with claim 7, wherein a width of a frontal sound field is shifted by varying a ratio between the center monophonic signal, and one of the output signal of the first delay means supplied to the add result output means and the output signal of the second delay means supplied to the subtract result output means.

9. A method for localizing a sound image reproduced with a pair of speakers arranged at positions left and right front sides of a listener so as to make the listener feel like surrounded by the sound image, the sound image being reproduced in accordance with at least a left front signal and a right front signal, the method comprising the steps of:

generating a differential signal between the left front signal and the right front signal, obtaining a side signal generated by filtering the differential signal in accordance with a transfer function $H_S$, obtaining a center monophonic signal by adding the left front signal and the right front signal, supplying a signal to one of the left speaker and the right speaker, the signal being generated by adding the center monophonic signal and the side signal, and supplying a signal to one of the left speaker and the right speaker, the signal being generated by subtracting the side signal from the center monophonic signal, wherein the transfer function is defined as an equation of $H_S=(h_{SS}-h_{SL})/(h_a-h_b)$, and wherein $h_{SS}$ is equal to a transfer function from a speaker virtually localized at the right side to the right ear of the listener and a transfer function from a speaker virtually localized at the left side to the left ear of the listener, and wherein $h_{SL}$ is equal to a transfer function from a speaker virtually localized at the left side to the right ear of the listener and a transfer function from a speaker virtually localized at the right side to the left ear of the listener, and wherein $h_a$ is equal to a transfer function from the right speaker to the right ear of the listener and a transfer function from the left speaker to the left ear of the listener, and wherein hb is equal to a transfer function from the left speaker to the right ear of the listener and a transfer function from the right speaker to the left ear of the listener.

10. An apparatus for localizing a sound image comprising:

a left front signal input terminal capable of supplying a left front signal, a right front signal input terminal capable of supplying a right front signal, a surround left signal input terminal capable of supplying a surround left signal, a surround right signal input terminal capable of supplying a surround right signal a first adding means for adding each of signals respectively carried out coefficient processings to the signals supplied through the left front signal input terminal and the right front signal input terminal, both the coefficient processings being carried out by using a first coefficient, a second adding means for adding each of signals, one of the signals carried out coefficient processing to the signal supplied through the left front signal input terminal, and the other signal carried out a coefficient processing to the signal supplied through the right front signal input terminal and the resulting signal being inverted its phase, both the coefficient processings being carried out by using a second coefficient, a third adding means for adding each of signals respectively carried out coefficient processings to the signals supplied through the surround left signal input terminal and the surround right signal input terminal, both the coefficient processings being carried out by using a third coefficient, a fourth adding means for adding each of signals, one of the signals carried out a coefficient processing to the signal supplied through the surround left signal input terminal, and the other signal carried out a coefficient processing to the signal supplied through the surround right signal input terminal and the resulting signal being inverted its phase, both the coefficient processings being carried out by using a fourth coefficient, a fifth adding means for adding an output of the first adding means and that of the third adding means, a sixth adding means for adding an output of the second adding means and that of the fourth adding means, a first filtering means for carrying out a filtering processing with a transfer function substantially equivalent to a transfer function $H_{SUM}$ to an output of the fifth output means, a second filtering means for carrying out a filtering processing with a transfer function substantially equivalent to a transfer function $H_{DIF}$ to an output of the sixth output means, a first delay means for carrying out a delay processing to the signal supplied through the left front signal input terminal for compensating a delay time caused by the first and the second filtering means, a second delay means for carrying out a delay processing to the signal supplied through the right front signal input terminal for compensating the delay time caused by the first and the second filtering means, a seventh adding means for adding each of outputs respectively carried coefficient processings to the outputs of the first delay means and the second delay means, both the coefficient processings being carried out by using a sixth coefficient, an eighth adding means for adding outputs respectively carried out coefficient processings to the outputs of the first delay means, that of the first filtering means, that of the second filtering means, and an output of the seventh adding means, the coefficient processing to the output of the first delay means being carried out by using a fifth coefficient, and the coefficient processings to the outputs of both the first filtering means and the second filtering means being carried out by using a seventh coefficient, and a ninth adding means for adding outputs, one of the outputs carried out a coefficient processings to the output of the second filtering means and the resulting output being inverted its phase, the remaining outputs respectively carried out coefficient processings to the outputs of the second delay means, that of the first filtering means, and an output of the seventh adding means, the coefficient processing to the output of the second delay means being carried out by using a fifth coefficient, and the coefficient processing to both the outputs of the first filtering means and that of the second filtering means being carried out by using a seventh coefficient, wherein an output of the eighth adding means is generated as a signal for a left speaker, and wherein an output of the ninth adding means is generated as a signal for a right speaker, and wherein both the transfer functions $H_{SUM}$, $H_{DIF}$ are defined as equations of $$H_{SUM}=(h_{a'}+h_{b'})/(h_a+h_b)$$

$$H_{DIF}=(h_{a'}-h_{b'})/(h_a-h_b)$$

and wherein equations $h_a=h_{LL}=h_{RR}$, $h_b=h_{LR}=h_{RL}$, $h_{a'}=h_{L'L}=h_{R'R}$, $h_{b'}=h_{L'R}=h_{R'L}$ are satisfied, and wherein $h_{RR}$ is a transfer function from the right speaker to the right ear of a listener, $h_{RL}$ is a transfer function from the right speaker to left ear of the listener, $h_{LL}$ is a transfer function from the left speaker to the left ear of the listener, $h_{LR}$ is a transfer function from the left speaker to the right ear of the listener, $h_{R'R}$ is a transfer function from a speaker virtually localized at the right side to the right ear of the listener, $h_{R'L}$ is a transfer function from the speaker virtually localized at the right side to the left ear of the listener, and $h_{L'L}$ is a transfer function from the speaker virtually localized at the left side to left ear of the listener, and $h_{L'R}$ is a transfer function from the speaker virtually localized at the left side to the right ear of the listener.

11. The apparatus in accordance with claim 10, wherein the apparatus further comprises a low frequency signal input terminal capable of supplying a low frequency signal, and a third delay means for carrying out a delay processing to the signal being input through the low frequency signal input terminal for compensating a delay time caused by the first and the second filtering means, and wherein an output carried out a coefficient processings using a ninth coefficient to an output of the third delay means is supplied to the eighth and ninth adding means, and wherein the apparatus further includes a first high-pass filtering means for eliminating low frequency component of an output carried out a coefficient processings using a eleventh coefficient to the output of the eighth adding means, a second high-pass filtering means for eliminating the low frequency component of an output carried out a coefficient processings using the eleventh coefficient to the output of the ninth adding means, a tenth adding means for adding each of outputs respectively carried out coefficient processings to the outputs of the eighth adding means and the ninth adding means, both the coefficient processings being carried out by using a twelfth coefficient, a low-pass filtering means for passing only the low frequency components of an output of the tenth adding means, and an eleventh adding means for adding an output carried out a coefficient processing using a tenth coefficient to the output of the third delay means and an output of the low-pass filtering means, and wherein an output of the first high-pass filtering means is generated as a signal for the left speaker, and wherein an output of the second high-pass filtering means is generated as a signal for the right speaker, and wherein an output of the eleventh adding means is generated as a signal for a woofer speaker.

12. The apparatus in accordance with claim 10, wherein the apparatus further comprises a center signal input terminal capable of supplying a center signal, a twelfth adding means for adding a signal carrying out a coefficient processing using an eighth coefficient to the signal supplied through the center signal input terminal and the signal supplied through the left front signal input terminal, and a thirteenth adding means for adding the signal carried out the coefficient processing using the eighth coefficient to the signal supplied through the center signal input terminal and a signal supplied through the right front signal input terminal, and wherein an output of the twelfth adding means is supplied to the first delay means as an input thereof, and wherein an output of the thirteenth adding means is supplied to the second delay means as an input thereof.

13. The apparatus in accordance with claim 11, wherein the apparatus further comprises a center signal input terminal capable of supplying a center signal, a twelfth adding means for adding a signal carrying out a coefficient processing using an eighth coefficient to the signal supplied through the center signal input terminal and the signal supplied through the left front signal input terminal, and a thirteenth adding means for adding the signal carried out the coefficient processing using the eighth coefficient to the signal supplied through the center signal input terminal and a signal supplied through the right front signal input terminal, and wherein an output of the twelfth adding means is supplied to the first delay means as an input thereof, and wherein an output of the thirteenth adding means is supplied to the second delay means as an input thereof.

14. A method for localizing a sound image comprising the steps of:

obtaining an add signal and a differential signal of a left front signal and a right front signal by carrying out coefficient processings to both the left front and the right front signal when both the left front and right front signal being applied, defining both the left front and the right front signal as an add front signal and a differential front signal respectively, obtaining an add signal and a differential signal of a surround left signal and a surround right signal by carrying out coefficient processings to both the surround left and the surround right signal when both the surround left and the surround right signal being applied, defining both the surround left and the surround right signal as an add surround signal and a differential surround signal respectively, supplying a signal calculated by adding both the add front signal and the add surround signal to a first filtering means forming a shuffler type filter, supplying a signal calculated by adding both the differential front signal and the differential surround signal to a second filtering means forming the shuffler type filter, obtaining both an add signal and a differential signal of signals respectively carried out coefficient processings to both an output of the first filtering means and an output of the second filtering means, defining both the add signal and the differential signal as a first left output element signal and a first right output element signal, defining both a signal respectively carried out coefficient processings to both the left front and the right front signal and a signal carried out coefficient processings to outputs of each delay means as a second left output element signal and a second right output element signal, adding outputs carried out coefficient processings to each outputs of the delay means, defining the outputs as both a third left output element signal and a third right output element signal, defining the first left, the second left and the third left output element signal as left output signals, and defining the first right, the second right and the third right output element signal as right output signals.

* * * * *